US005479673A

United States Patent [19]

Carton

[11] Patent Number: 5,479,673

[45] Date of Patent: Jan. 2, 1996

[54] REVERSIBLE SCRUB BRUSH AND SCRAPER

[76] Inventor: Bruce M. Carton, c/o Trim Brush Company Inc., 22 Littell Rd., East Hanover, N.J. 07936

[21] Appl. No.: 360,365

[22] Filed: Dec. 21, 1994

[51] Int. Cl.[6] ..... A47L 13/12; A46B 17/08

[52] U.S. Cl. ..... 15/111; 15/105; 15/114; D4/116; D32/42

[58] Field of Search ..... 15/105, 111, 113, 15/114; D4/116, 118, 119, 120, 137; D32/42

[56] References Cited

U.S. PATENT DOCUMENTS

| | | | |
|---|---|---|---|
| D. 282,604 | 2/1986 | Whitaker | D4/116 |
| 3,199,139 | 8/1965 | Vallis | 15/114 |
| 3,366,987 | 2/1968 | Giustino | 15/105 |
| 3,434,175 | 3/1969 | Bray | 15/114 |
| 3,968,535 | 7/1976 | Nichols, Jr. | 15/105 |
| 4,091,579 | 5/1978 | Giangiulio | 15/111 |
| 4,407,213 | 10/1983 | Evans | 15/114 |
| 4,414,700 | 11/1983 | Burns | 15/105 |
| 5,351,356 | 10/1994 | Townsend, Jr. | 15/114 |

*Primary Examiner*—Mark Spisich
*Attorney, Agent, or Firm*—Paul R. Gauer

[57] ABSTRACT

A cleaning tool with an elongated handle having a storage hook at one end and in one aspect a modified "V" shaped work piece holder at the opposite end. Optimally, the workpiece holder has bristles on a short side, a scouring pad on a long side and a scraper on its base. The best ratio for workpiece holder supports is two on the long side for every one on the short side. The optimum placement of worksurfaces is with the scrubber and bristles one inch apart and 26 degrees from the longitudinal axis of the handle and the scraper at the longitudinal axis of the handle and offset to one side. One form of scraper has a rounded nose tailored for cleaning between barbeque grill wires.

13 Claims, 2 Drawing Sheets

REVERSIBLE SCRUB BRUSH AND SCRAPER

Figure 1:
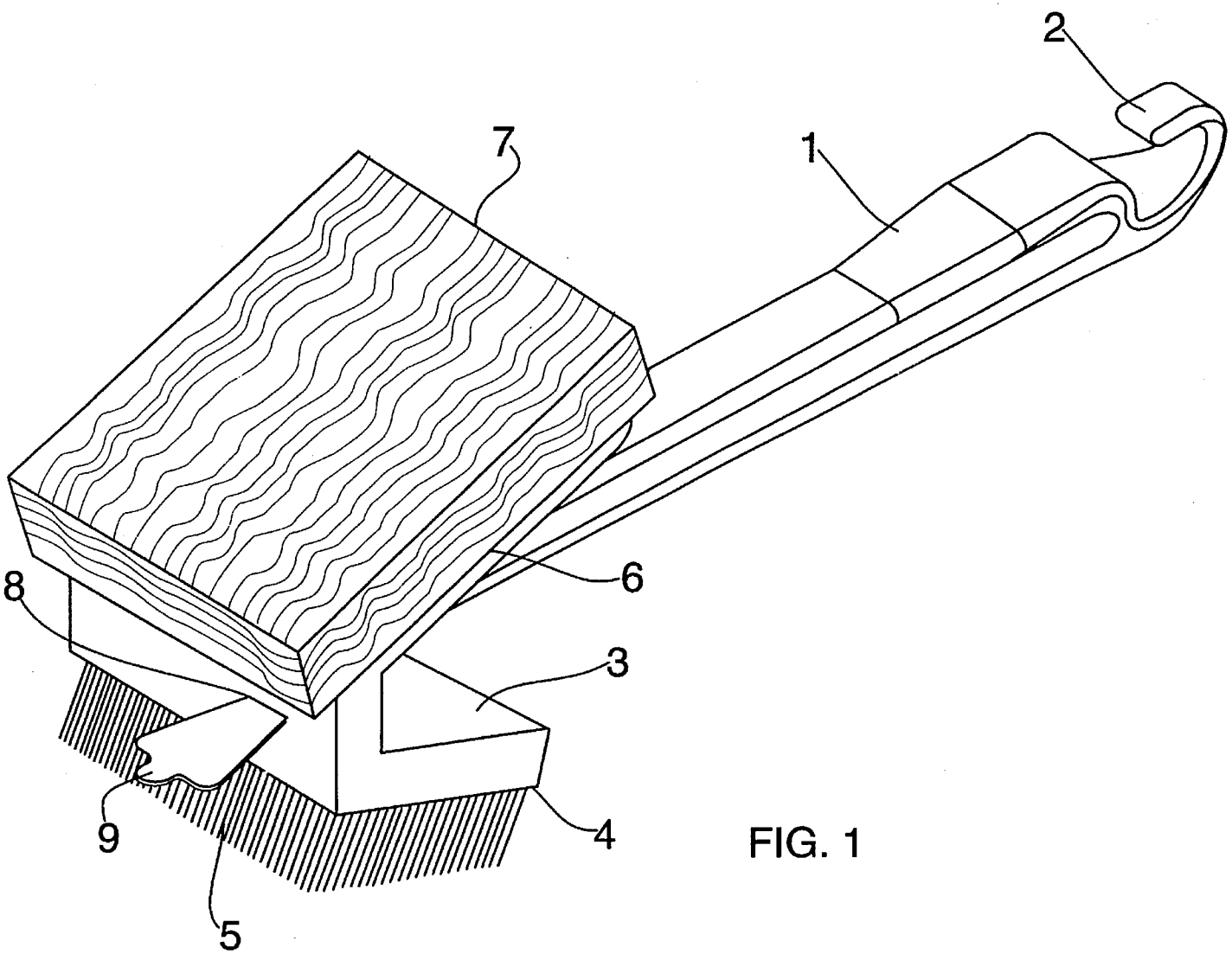

This invention relates to household tools, and, more particularly to household cleaning tools having a combination of brush, scrubber and scraper.

BACKGROUND ART

Cleaning a barbeque grill is one of the more arduous of household tasks. Various greases and remnants from the barbequed meal adhere to the barbeque grill itself and are difficult to remove with ordinary cleaning techniques. This invention was initially devised to resolve these problems but has resulted in a household cleaning tool which with variations has more general application.

A few previous attempts have been made to create tools to solve these problems.

U.S. Pat. No. Des. 282604 is for a brush, pad and scraper held in one small piece in one's hand and providing little protection from the hot grill.

U.S. Pat. No. 4,091,579 has an elongated handle, a barrier interposed between the work end and handle and fastened scraper and scouring pad at the working end. The handle shape and fasteners make this costly to manufacture. The workpiece holder is not optimal for uneven application of forces in use. The shape of the scraper is not tailored to barbeque grills and presents possible safety hazards.

U.S. Pat. No. 4,146,943 has an elongated handle without a protection barrier, and with, on its working end, rotatable cutter discs and a brush to sweep out debris.

U.S. Pat. No. Des. 333,921 is for an ornamental design for a combined dishwashing brush and scraper.

OBJECTS OF THE INVENTION

One object of the invention is to provide an all in one tool for scrubbing, scraping, and cleaning household tasks including barbeque grills.

Another object of the invention is to protect the users hands from contacting with a hot surface while using the tool.

A further object of the invention is to locate the working surfaces in the optimum juxtaposition for the most efficient cleansing movements.

Another object of the invention is to reduce the cost of manufacture by minimizing the number of fasteners and shapes to create a reusable but disposable tool.

Still another object is to design a scraper whose form is tailored uniquely for barbeque grills.

Yet another object is to design the scraper with rounded edges to reduce safety hazards.

A still further object of the: invention is to provide ease of storage.

SUMMARY OF INVENTION

In this invention the foregoing objectives are attained by a household cleaning tool with an elongated handle having a hook at one end and a workpiece holder at the opposite end. Said workpiece holder has a modified "V" shape which at once prevents the hands from contacting the work surfaces and presents bristles, scrubber and scraper in optimum positions for maximum cleaning leverage and comfort.

The preferred placement of the workpieces involves a ratio of supports for the workpiece holder of two on the longer "V" side for every one on the shorter "V" side in which the bristles are staple-set into the shorter side, the scrubber glued to the longer side and the scraper wedged into the flattened "V" base, affixed by its teeth and offset to one side so the user can see it while scraping. The scrubber and bristles optimally are separated at least one inch from each other and both angled approximately 26 degrees from the longitudinal axis of the handle for maximum cleaning leverage and user comfort.

In accordance with an aspect of the invention designed for cleaning barbeque grills, the bristles would be wire and the scraper would have a rounded nose for cleaning the tops and sides of adjacent grill wires simultaneously.

The tool can be easily flipped from side to side for alternate use of the bristles or scrubber with greater support provided when using the scrubber where more force is applied. The mounting of the scraper offset to a side at the tip of the tool on the flattened "V" base allows for ease of use and sight with backward and forward scraping movement.

DRAWING SUMMARY

FIG. 1—Perspective view

FIG. 2—Side view

Figure 3:
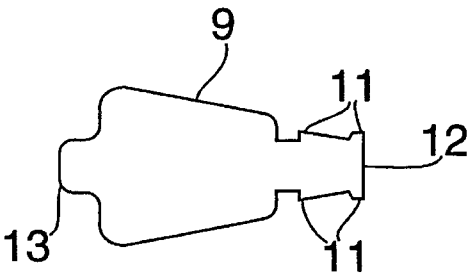

FIG. 3—Top view of scraper

BEST MODE FOR PRACTICING THE INVENTION

In FIG. 1 an elongated handle 1 has hook means 2 on one end and a workpiece holder 3 on the opposite end. The workpiece holder 3 has means 4 for fastening (preferably staple-set) bristles (usually wire or polypropylene) 5 on its short side, means 6 for fastening (usually glue), a scouring pad 7 on its long side and means 8 for fastening (preferably wedged) a scraper 9 at the base. The scraper 9 is best offset to one side for ease of sight while scraping.

Figure 2:
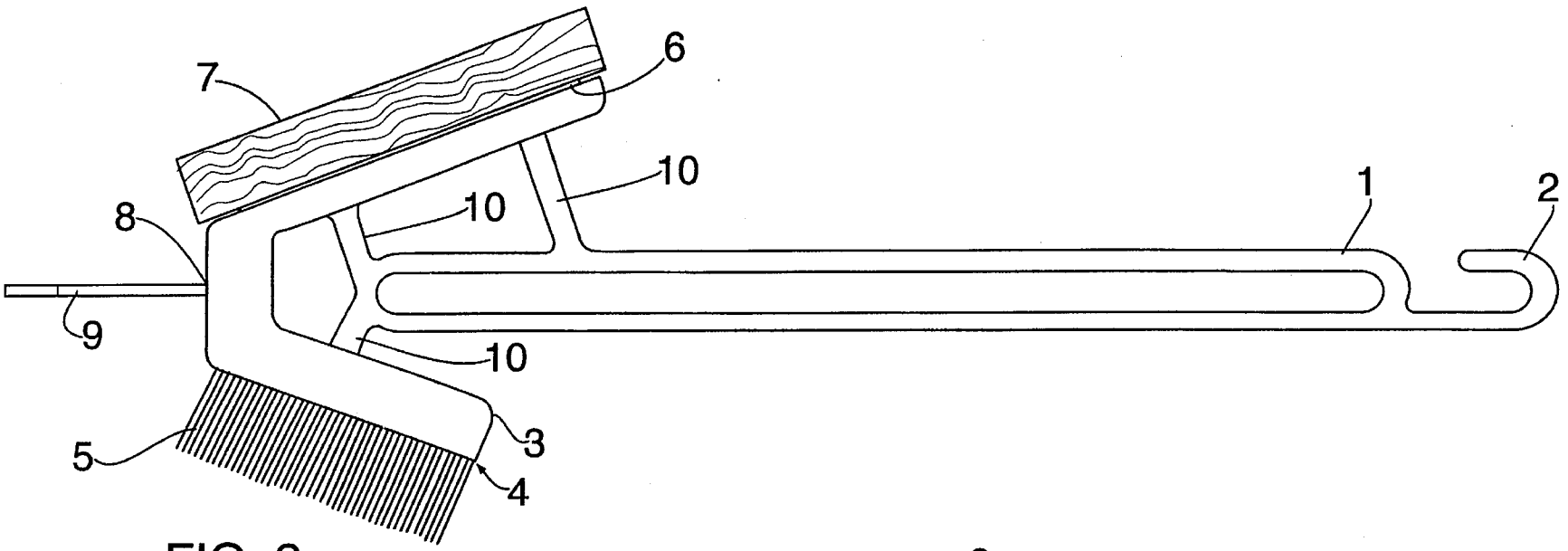

In FIG. 2 the elongated handle 1 is shown with hook means 2 on one end and a modified "V" shaped workpiece holder 3 on the opposite end connected to the handle by braces 10 located at the optimum pressure points for strength during work. The workpiece holder 3 has means 4 for fastening bristles (usually wire or polypropylene) 5 on its short side, means 6 for fastening (usually glue) a scouring pad 7 on its long side and means 8 for fastening (preferable wedged) a scraper 9 at is apex.

In FIG. 3 the scraper 9 is shown with teeth 11 on its base 12 for gripping when wedged into workpiece holder 3 usually constructed of molded plastic and a rounded cleansing nose 13 at its apex.

I claim:

1. A tool comprising:

an elongated handle having first and second opposite ends, hook means at the first end, a workpiece holder at the second opposite end of the handle, containing:

first means for fastening a scouring pad, a scouring pad fastened to the workpiece holder by the first means, second means for fastening bristles, bristles fastened to the workpiece holder by the second means, third means for fastening a scraper and a scraper fastened to the workpiece holder by the third means, wherein the workpiece holder has a modified "V" shape with a short side, a long side and a flat base intermediate said short and long sides.

2. The tool of claim 1 wherein the bristles are attached to the short side of the "V", the scouring pad to the long side of the "V", and the scraper to the flat base.

3. The tool of claim 1 wherein the ratio of the length of the long side to the length of the short side is two to one.

4. The tool of claim 1 wherein the scouring pad is separated from the bristles by at least one inch.

5. The tool of claim 1 wherein the scouring pad and bristles are each angled approximately 26 degrees relative to the longitudinal axis of the handle.

6. The tool of claim 1 wherein the first means for fastening the scouring pad is glue.

7. The tool of claim 1 wherein the second means for fastening the bristles in staple-set.

8. The tool of claim 1 wherein the third means for fastening the scraper is teeth formed on the scraper which are wedged into the workpiece holder.

9. The tool of claim 1 wherein the bristles are wire.

10. The tool of claim 1 wherein the scraper has a rounded nose.

11. The tool of claim 1 wherein the bristles are polypropylene.

12. The tool of claim 1 wherein the scraper is aligned with the longitudinal axis of the handle and offset to a side portion of the flat base.

13. The tool of claim 1 wherein the workpiece holder has two supports on the long side and one support on the short side for attachment to the handle.

* * * * *